United States Patent [19]

Allen

[11] Patent Number: 4,697,441

[45] Date of Patent: Oct. 6, 1987

[54] HANDCUFFS

[76] Inventor: Mark L. Allen, 1776 E. 13th St., Brooklyn, N.Y. 11229

[21] Appl. No.: 928,308

[22] Filed: Nov. 6, 1986

[51] Int. Cl.[4] ..... E05B 75/00

[52] U.S. Cl. ..... 70/16; 70/14; 70/18

[58] Field of Search ..... 70/14–18

[56] References Cited

U.S. PATENT DOCUMENTS

| | | | |
|---|---|---|---|
| 647,735 | 4/1900 | Widmayer | 70/16 |
| 1,780,473 | 11/1930 | Gill | 70/16 |
| 1,881,577 | 10/1932 | Hillyard | 70/16 |
| 2,966,787 | 1/1961 | Tompkins | 70/16 |
| 3,146,614 | 9/1964 | Von Frantzius | 70/16 |
| 3,618,345 | 11/1971 | Smith | 70/16 |
| 4,138,867 | 2/1979 | Tompkins | 70/16 |
| 4,162,622 | 7/1979 | Daleo | 70/16 |
| 4,300,368 | 11/1981 | Sullivan | 70/16 |
| 4,314,466 | 2/1982 | Harris | 70/16 |
| 4,574,600 | 3/1986 | Moffett | 70/16 |

FOREIGN PATENT DOCUMENTS

| | | | |
|---|---|---|---|
| 366681 | 9/1921 | Fed. Rep. of Germany | 70/16 |

*Primary Examiner*—Robert L. Wolfe
*Assistant Examiner*—Suzanne L. Dino
*Attorney, Agent, or Firm*—William P. Keegan

[57] ABSTRACT

A pair of wrist shackles or handcuffs in which one handcuff is joined to a second handcuff by a single pivot member that permits one handcuff to pivot or rotate in a planar direction to overlay the other handcuff.

4 Claims, 4 Drawing Figures

HANDCUFFS

FIELD OF THE INVENTION

The invention relates to shackles, and more particularly to a pair of wrist shackles or handcuffs.

BACKGROUND OF THE INVENTION

Handcuffs of the type to which the present invention pertains are well known, and, except perhaps for the lock itself, have not undergone any change for a good many years. These handcuffs comprise a pair of wrist shackles joined together so that the wrists of a prisoner can be secured one to the other. The joining of the shackles is generally accomplished by the use of a short chain connected at each end to a shackle by a swivel. See, for example, U.S. Pat. No. 1,157,135. While chain connected handcuffs are most widely used, it is recognized that the less mobility the prisoner has in moving his hands and arms the greater the security in restraining the prisoner. Thus, there also are handcuffs in which one handcuff is hinged to the other with the hinge pin being parallel to the plane of the handcuffs to permit the handcuffs to be folded into an overlapping position. See, for example, U.S. Pat. No. 4,138,867. In both cases one handcuff can be placed compactly atop the other for easy storage in a user's belt pouch or handcuff case. In both the chain connected or the hinged handcuffs, each handcuff comprises a frame section that includes a lock housing having two parallel spaced apart semi-circular or arcuate arms depending therefrom. At the distal end of the arms, a semi-circular jaw or shackle member is pivotally connected so that its remote end, which is formed with a ratchet on its outer surface, can be pivoted into engagement with a ratchet bolt of the lock. In the event that the arms and shackle member of the handcuffs do not encircle, for example, a person's wrist, the shackle member continues to pivot past the ratchet bolt and between the spaced apart arms of the handcuff until its ratchet end again comes into engagement with the ratchet bolt of the lock.

GENERAL DESCRIPTION OF THE INYENTION

It is the object of the present invention to provide an improved pair of handcuffs.

It is another object of the invention to provide handcuffs that more securely restrain a handcuffed person than chain connected handcuffs.

It is still another object of the invention to provide handcuffs that are easier and less costly to manufacture and which have a minimum number of parts.

It is another object of the invention to provide a pair of handcuffs in which one handcuff is connected to the second handcuff by a single pivot pin member.

It is yet another object of the invention to provide handcuffs that can be set in a ready to use or cocked condition by reverse ratcheting of the shackle member.

It is still another object of the invention to provide improved handcuffs that are easier or more convenient to use, especially when handcuffing a recalcitrant or resisting person.

In carrying out the invention, handcuffs of the type referred to above are connected one to the other by a single pivot pin member that extends perpendicularly through the lock housings of the two handcuffs, i.e., perpendicularly to the planes of the handcuffs, so that one or the other handcuff can be pivoted into position over the other handcuff. Moreover, each handcuff is provided with a shackle member in which the last tooth of the ratchet is shaped so that it will pass under the last ratchet tooth of the spring biased ratchet bolt when the shackle member is pivoted in a "reverse" direction. Such an arrangement permits the handcuff to be put in a so-called cocked or ready position by reverse pivoting of the shackle member rather than by moving the shackle member past the ratchet bolt and counting the ratchet clicks until only the last shackle ratchet tooth is engaged by the bolt.

Features and advantages of the invention may be gained from the foregoing and from the description of a preferred embodiment of the invention which follows.

DETAILED DESCRIPTION OF THE INVENTION

Figure 1:
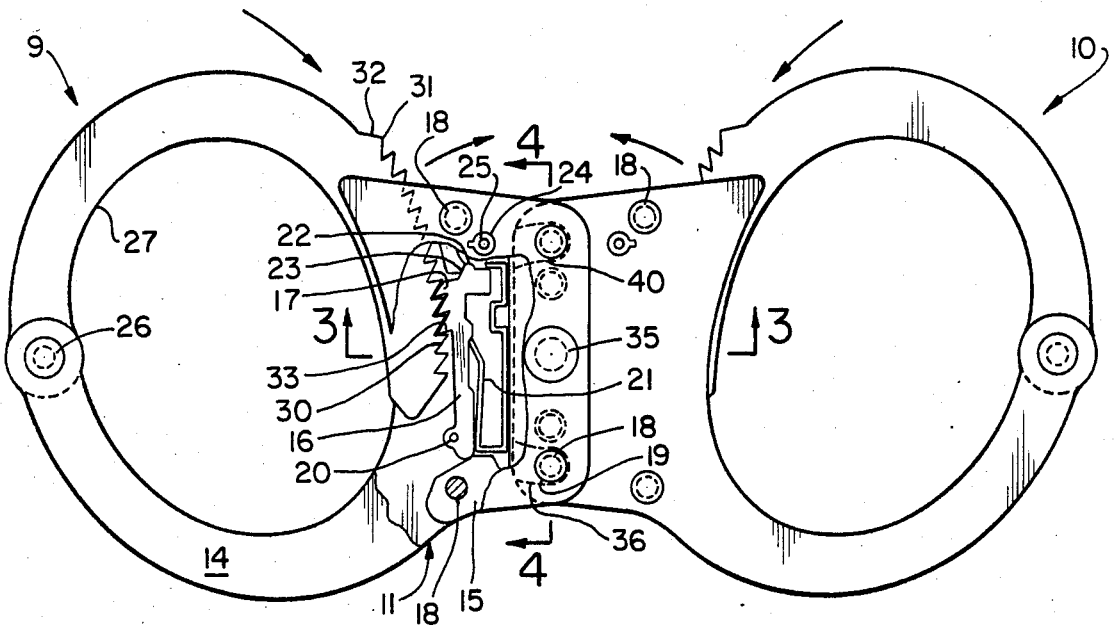
FIG. 1 is a top plan view, with a part thereof broken away, of a pair of handcuffs according to the present invention.
Figure 2:
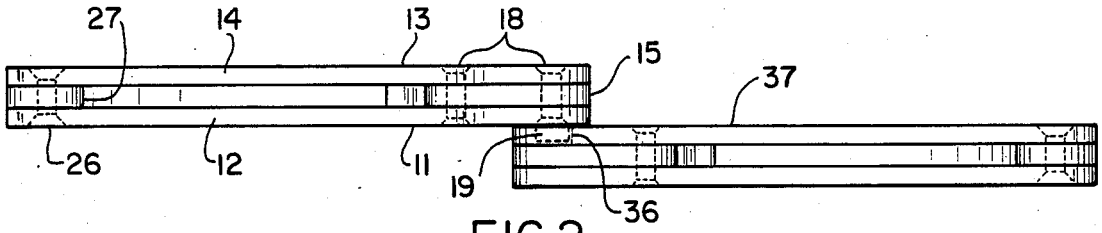
FIG. 2 is an elevational view of the improved handcuffs.
Figure 3:
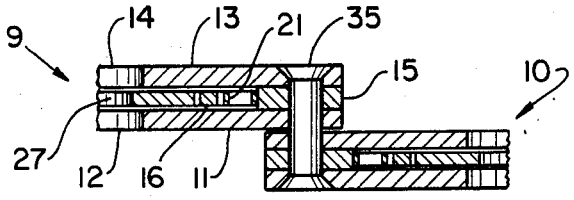
FIG. 3 is a sectional view taken along line 3—3 of FIG. 1.
Figure 4:
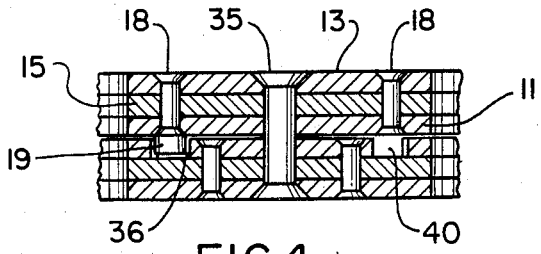
FIG. 4 is a sectional view taken along line 4—4 of FIG. 2.

FIG. 1 shows a pair of handcuffs 9 and 10 each of which comprises a rear frame member 11 having a depending arm 12 and a similar front frame member 13 having a depending arm 14 sandwiching a bolt housing 15. Within housing 15 are a bolt 16 formed with several ratchet teeth 17, a pin 20 on which bolt 16 is pivotally mounted, and a spring 21 which biases the bolt into the position wherein bolt shoulder 22 engages abutment 23 of housing 15. After the bolt 16 and spring 21 are in place in housing 15, the assembly of rear frame member 11, housing 15, and front frame member 13 are joined together by rivets 18 to form a rigid assembly comprising a look section with two depending spaced apart arms 12 and 14. It will be noted that all rivet heads, except rivet head 19, are countersunk and flush with the surfaces of frame members 11 and 13. Rivet head 19 projects from the surface of frame member 11 for a purpose that will be disclosed hereinafter.

Front frame member 13 is provided with a keyhole 24 and rear member 11 with a key post 25 that guides and steadies a key inserted in keyhole 24 to unlock the handcuff.

The distal ends of arms 12 and 14 are provided with a pivot pin 26 (also countersunk and flush with the surfaces of arms 12 and 14) that supports shackle member 27 for rotational movement about pin 26. The forward end of member 27 is provided on its outside edge with a series of ratchet teeth 30 that cooperate with ratchet teeth 17 of bolt 16. The arrangement is such that shackle member 27, when unimpeded, can ratchet past bolt 16 and between arms 12 and 14 and continue clockwise movement around pin 26 until it aqain engages bolt 16. The ratchet arranqement, in general, prevents rotation of shackle member 27 in the reverse direction. However, the last tooth 31 of the shackle member ratchet teeth 30 is provided with an angularly disposed ramp 32 that permits the last tooth 33 of the bolt ratchet teeth to slide up tooth 31 and fall into a position engaging ratchet tooth 31 when shackle member 27 is moved in a counterclockwise direction. The significance of this is that shackle member 27 can be placed in a cocked or ready position by flicking or rotating shackle member 27 in a counterclockwise direction.

If the handcuffs, as shown in FIG. I are encircling a person's wrist, the handcuff may be opened by a key (not shown) inserted through keyhole 24 and then turned in a counterclockwise direction to engage bolt 16 and pivot it clockwise about pin 20 to disengage bolt ratchet teeth 17 from shackle member ratchet teeth 30. Shackle member 27 can then be pivoted in a counterclockwise direction to free the person's wrist.

Handcuff 9 is connected to handcuff 10 by a pivot pin member 35 which may simply be a rather substantial rivet passing perpendicularly through housing 15 of handcuff 9 and the similar housing of handcuff 10. Pivot pin 35 is countersunk so that it is flush with the surface of the handcuffs. It is to be noted especially that, compared to the conventional chain connected or hinged handcuffs, the pivot pin means for connecting one handcuff to the second handcuff results in a significant reduction in the number of parts needed to manufacture a pair of handcuffs. Specifically, the pivot pin connected handcuffs requires only a single pivot member rather than a number of welded chain links and swivels in chain connected handcuffs and hinge pins and hinge links in hinged handcuffs. As shown in FIG. 1, rivet head 19 is positioned in groove 36 formed in front frame member 37 of handcuff 10. Since the groove extends only as far as shown in the drawing, handcuff 9 cannot be pivoted counterclockwise beyond the position in which it is shown. Uowever, handcuff 9 can be pivoted clockwise until rivet head 19 engages groove 40 also formed in front frame member 37 of handcuff 10 in which position, handcuff 9 will be pivoted compactly over handcuff 10 ready for storage in a user's belt pouch.

It is preferred that the keyhole for both handcuffs 9 and 10 be on one side of the connected handcuffs as shown in FIG. 1. In such case, the two handcuffs are not identical. If, however, it is acceptable for the keyholes to be on opposite sides of the connected handcuffs and the shackle members to rotate in the same direction (in FIG. 1 the shackle member of handcuff 10 rotates counterclockwise), both handcuffs can be identical to each other if the detent feature provided by grooves 36 and 40 and rivet head 19 is foregone. Thus, the number of different parts required to manufacture a pair of handcuffs will be further reduced.

In use, handcuffs are usually carried in a cocked position in which the last tooth of the ratchet on shackle member 27 is engaged by bolt 16. When a handcuff is to be placed on a person's wrist, the cocked shackle member 27 is pushed between arms 12 and 14 of the frame member, past and again into engagement with the bolt 16, thus encircling the person's wrist. If the person to be handcuffed is docile and compliant, the cuff can be placed on the wrist using both hands of the user. However, if the person is recalcitrant and struggling, the task of applying the handcuff becomes more difficult.

In such cases, police instructors teach many techniques for overcoming that resistance so as to apply the handcuffs. Many of these techniques require flicking the handcuff onto the person's wrist. This is done by grasping the person's wrist, placing the outer edge of the cocked shackle member 27 against the wrist and pressing down hard. This procedure drives the shackle member past the ratchet teeth of the bolt, and once the ratchet teeth of shackle member 27 are free of the bolt, the shackle member flies around between the spaced apart arms 12 and 14 of the frame (clockwise in FIG. 1) until it again engages bolt 16, this time encircling the person's wrist. In order to minimize the pressure needed to cause the shackle member to rotate as described, users are taught to cock or set the handcuffs with only the last tooth of the shackle member ratchet engaged with the bolt ratchet. This requires the user to know the number of ratchet teeth on the shackle member and then to count the number of ratchet clicks as the shackle member is advanced past the bolt.

Even so, with conventional handcuffs, the user gets only one opportunity to flick the handcuff onto a person's wrist. If a handcuff is not applied to a person's wrist the first time it is flicked, the shackle member hangs free on its pivot pin and there is, for all intents and purposes, no way for the user to reset the handcuff in a cocked or ready position while at the same time struggling with a resisting person.

With the improved handcuff disclosed herein, the handcuff can be reset as many times as necessary by propelling the shackle member in a counterclockwise direction, as viewed in the drawing. This can be accomplished, one handedly, by holding the handcuff near the lock section and with a rapid twist of the user's wrist propelling the shackle member in the required direction. This will cause the last tooth on the shackle member to engage the bolt ratchet and thus cock the handcuff. If then, an attempt is made to flick the cocked handcuff onto a person's wrist and the attempt fails, the handcuff can be re-cocked as many times as necessary by a rapid twist of the user's wrist, even while struggling with a resisting person.

Having thus described the invention, it is to be understood that many apparently widely different embodiments can be made therein without departing from its spirit and scope. For example, instead of modifying the shackle member ratchet as disclosed, the bolt ratchet may be modified to permit the shackle member to move in a reverse direction past the modified bolt ratchet tooth, Or, both the last ratchet tooth of both the shackle member and the bolt may be modified. Another embodiment would provide a spring biased detent to hold the shackle member in a cocked condition with the ratchet teeth of the shackle member out of engagement with the bolt. In this latter embodiment, the ratchet teeth of the shackle member and the bolt need not be modified. Therefore, it is intended that the foregoing specification and the accompanyinq drawing be interpreted as illustrative rather than in a limiting sense.

What is claimed is:

1. A pair of handcuffs comprising a first handcuff and a second handcuff, wherein each handcuff includes a lock section having a spring loaded bolt member with ratchet means formed thereon, a pair of fixed spaced apart arcuate arms depending from said lock section and provided with a pivot at the end thereof remote from said lock section, and an arcuate shackle member rotatably supported on said pivot for 360 degree rotation past said lock section and between said spaced apart arcuate arms, said shackle member having a series of ratchet teeth formed at the free end thereof for cooperation with the ratchet means formed on said bolt member, pivot pin means connecting said first handcuff to said second handcuff in an offset relationship, said pivot pin means passing transversely throught the lock section of each handcuff so that the lock section of one handcuff partially overlays the lock section of the other handcuff when the handcuffs are in an edge to edge relationship and ready for use and one handcuff can be pivoted in the plane of the handcuff to overlayp the other handcuff when the handcuffs are to be stored, and detent means for limiting the movement of one handcuff relative to the other to aproximately 180 degrees from an overlapping relationship to an edge to edge relationship ready for use and vice versa, wherein said detent means comprises a member depending from one handcuff lock section, said member abutting one part of the lock section of the other handcuff when the handcuffs are in an overlapping relationship and another part of the lock section of the other handcuff when the handcuffs are in an edge to edge relationship,

2. A pair of handcuffs according to claim 1 wherein said depending member is a projecting rivet head on the handcuff that pivots into closed-end grooves formed on the other handcuff to limit the extremes of movement of the handcuffs.

3. A pair of handcuffs according to claim 1 wherein the shackle member of each handcuff is provided with at least one additional shackle tooth adjacent the ratchet tooth most remote from the free end of said shackle member which additional tooth will pass under the ratchet means of said bolt member when engaging said ratchet means from either direction and will detent said shackle member relative to said bolt member.

4. A pair of handcuffs according to claim 1 wherein the bolt member is modified so that the shackle member ratchet tooth most remote from the free end of said shacle member will pass under the ratchet means of said bolt member when engaging said bolt member from either direction.

* * * * *